US008064609B2

(12) United States Patent
Baechler et al.

(10) Patent No.: US 8,064,609 B2
(45) Date of Patent: Nov. 22, 2011

(54) METHOD AND APPARATUSES RELATED TO HEARING DEVICES, IN PARTICULAR TO MAINTAINING HEARING DEVICES AND TO DISPENSING CONSUMABLES THEREFORE

(75) Inventors: Herbert Baechler, Meilen (CH); Stefan Launer, Zurich (CH); Bernd Waldmann, Maur (CH)

(73) Assignee: Phonak AG, Staefa (CH)

( * ) Notice: Subject to any disclaimer, the term of this patent is extended or adjusted under 35 U.S.C. 154(b) by 1432 days.

(21) Appl. No.: 11/465,846

(22) Filed: Aug. 21, 2006

(65) Prior Publication Data

US 2008/0037798 A1 Feb. 14, 2008

(30) Foreign Application Priority Data

Aug. 8, 2006 (WO) ..... PCT/EP2006/065152

(51) Int. Cl.
*H04R 25/00* (2006.01)

(52) U.S. Cl. ..... 381/60; 381/312; 381/314

(58) Field of Classification Search ..... 381/23.1, 381/60, 312, 314, 315, 323, 58; 73/585; 600/559

See application file for complete search history.

(56) References Cited

U.S. PATENT DOCUMENTS 5,479,522 A 12/1995 Lindemann et al.
7,200,237 B2 * 4/2007 Zhang et al. ..... 381/60
2004/0184618 A1 9/2004 Bengtsson
2004/0190739 A1 9/2004 Bachler et al.
2005/0271186 A1 12/2005 Lichorowic et al.
2007/0009124 A1 * 1/2007 Larsen ..... 381/315

FOREIGN PATENT DOCUMENTS

EP 1324240 A1 2/2003
WO 0154458 A2 7/2001
WO 0154458 A3 7/2001
WO 2004110099 A2 12/2004

OTHER PUBLICATIONS

International Search Report dated Mar. 22, 2007 in reference to international application No. PCT/EP2006/065152.

* cited by examiner

*Primary Examiner* — Huyen D Le
(74) *Attorney, Agent, or Firm* — Pearne & Gordon LLP

(57) ABSTRACT

The method comprises the steps of automatically monitoring and detecting indications indicative of a forthcoming event concerning hearing systems;

if such an indication is detected, retrieving identification data identifying at least one device of the hearing system concerned, referred to as specific device, or a user of said hearing system concerned, referred to as specific user; and using said identification data for retrieving further data related to said specific device as device data or related to said specific user as user data.

The method and the corresponding system can be used for adjusting said specific hearing system or other support actions, like dispensing consumables for said specific hearing system, or preparatory actions, like launching a suitable fitting program or loading audiological data related to the user.

33 Claims, 7 Drawing Sheets

METHOD AND APPARATUSES RELATED TO HEARING DEVICES, IN PARTICULAR TO MAINTAINING HEARING DEVICES AND TO DISPENSING CONSUMABLES THEREFORE

TECHNICAL FIELD

The invention relates to the field of hearing devices. It relates to methods and apparatuses according to the opening clauses of the claims, in particular to a method and a system for maintaining a hearing device and to a method and a system for dispensing consumables or accessories for a hearing device.

Under "hearing device" a device is understood, which is worn adjacent to or in an individual's ear with the intent to improve the individual's hearing capacity. Such improvement may also be barring acoustical signals from being perceived in the sense of hearing protection for the individual. If the hearing device is tailored so as to improve the perception of a hearing impaired individual towards the hearing perception of an individual with ordinary hearing, then we speak of a hearing-aid device. With respect to the application area, a hearing device may be applied behind the ear, in the ear, completely in the ear canal or may be implanted.

A system comprising at least one hearing device is referred to as "hearing system". Typically, a hearing system comprises two hearing devices. Further devices of a hearing system can be, e.g., remote controls.

BACKGROUND OF THE INVENTION

Hearing devices usually have to be adjusted to the needs and preferences of the user of the hearing device. This adjusting, also referred to as fitting, is typically done during several fitting sessions. The fitting may involve the measurement of audiograms and other audiological data of the user, an initial fitting and several steps of fine-tuning the fitting as well as the definition of several hearing programs providing for an optimized hearing sensation in different acoustic environments. This is known, in particular, in the field of hearing-aid devices. Hearing device fitting requires very specific skills, and it is different for different hearing device users, since the hearing abilities of each user are very individual. Therefore, the fitting and the corresponding programming of the hearing devices is usually done by an audiologist or another hearing care professional.

Typically, the hearing care professional has a programming environment with one or several computers, each of which has an interface unit to connect to a hearing device or to a pair of hearing devices. The provision of several computers allows working with several hearing device users at the same time, typically in different examination rooms. Hearing devices of different hearing device manufacturers require the use of different programming software for fitting, also referred to as fitting programs. In order to simplify dealing with different fitting programs, software-hardware platforms with dedicated interfaces have been developed, which allow to connect hearing devices of different hearing device manufacturers to said dedicated interface attached to a general purpose computer. By means of the software of such a software-hardware platform, a hearing-device-manufacturer-specific fitting program can be launched, with the information, what kind of hearing device model shall be fitted and for which specific user the hearing device shall be fitted. This way, the appropriate type and version of the hearing-device-manufacturer-specific fitting program is launched, or appropriate parameters in the hearing-device-manufacturer-specific fitting program are set, and data related to the hearing of the user, like audiograms, as well as former hearing device settings, are in access and used in the hearing-device-manufacturer-specific fitting program. A well-known example of such a software-hardware platform in the field of hearing-aid devices is known as "NOAH".

The invention arose from the desire for time savings in fitting sessions, without decreasing the quality of the fitting.

It has turned out that it takes a considerable amount of time to launch a fitting software, even if performed by a software-hardware platform as described above.

The inventive ideas solving that problem turned out to be applicable to further problems, too, like the dispensing of consumables or accessories for hearing devices.

The unpublished patent applications with the application numbers U.S. Ser. No. 11/395,788 and EP 06 112 108.3 of the same applicant, filed on Mar. 31, 2006, and entitled "Method and system for adjusting a hearing device", disclose a method for wirelessly adjusting one or more hearing devices, by using a wireless network or wireless transmitter, respectively. By means of this, an audiologist can unambiguously assign one or two hearing devices in a fitting session, even if multiple hearing devices lie on the desktop within the range of the wireless network or wireless transmitter, respectively.

US 2002/0054689 A1 discloses a method and a system for remotely upgrading a hearing device by downloading software resources over a network from a remote server to a local client.

SUMMARY OF THE INVENTION

As has been depicted above, one objective of the present invention is to provide a method and an arrangement, which allow time savings in fitting sessions. In particular, a method for maintaining a hearing device and a system for maintaining a hearing device shall be provided.

In addition, a method for dispensing consumables or accessories for a hearing system, and a system for dispensing consumables or accessories for a hearing system are provided. An objective of these is to simplify said dispensing. Another objective thereof is to avoid mistakes in dispensing said consumables or accessories. Such mistakes could occur, e.g., during manual dispensing, when a consumable or accessory is selected and dispensed, that is not suitable for the specific hearing system, though it might be appropriate for another type or model of hearing device.

Further objects emerge from the description and embodiments below.

At least one of these objectives is at least partially achieved by a method or by an arrangement or system according to the invention.

The method comprises the steps of

- automatically monitoring or detecting indications indicative of a forthcoming event concerning hearing systems;
- if such an indication is detected, retrieving identification data identifying at least one device of the hearing system concerned, referred to as specific device, or a user of said hearing system concerned, referred to as specific user;
- using said identification data for retrieving further data related to said specific device as device data or related to said specific user as user data.

The arrangement comprises

- a detecting module for automatically monitoring or detecting indications indicative of a forthcoming event concerning hearing systems;
- an identifying module operationally connected to said detecting module, for retrieving identification data of at least one device of the hearing system concerned, referred to as specific device, or of a user of said hearing system concerned, referred to as specific user, and for outputting identification data identifying said specific user or said specific device;

a data accession module operationally connectable to data sources comprising data related to users of hearing systems or data related to hearing systems or data related to hearing devices, for retrieving further data from said data sources related to said specific user as user data or to said specific device as device data, and for outputting said user data or device data.

Accordingly, in an automated fashion, it is detected, that said specific user of said specific hearing system is expected to have an event concerning the hearing system in the near future, e.g. an interaction between the user and his hearing care professional. This interaction may be a scheduled or unscheduled meeting of said user with the user's hearing care professional or a person related to (in particular working for) said hearing care professional, or a scheduled or unscheduled interaction of said user with a hearing-device-related apparatus, e.g., a machine or computer associated with a hearing care professional, typically located at or near the hearing care professional's office.

A hearing care professional is a person professionally concerned with hearing devices, e.g., an audiologist, a hearing aid dispenser or another person who is responsible for support or maintenance for a hearing device or for purchasing a hearing device.

The term "automatically", e.g., in the above-mentioned "automatically monitoring or detecting", means that the corresponding process is accomplished in a machine-controlled manner, with no need for support of an individual required to accomplish the task, e.g. said monitoring or detecting.

After detecting that said forthcoming event is to be expected, the user and/or his hearing system is identified and said identification data are obtained. Preferably, also this step is carried out automatically, since this way, time can be saved and manual actions and the occurrence of mistakes can be reduced. Said identification data can comprise, e.g., the specific user's name or client number, or the model and serial number of the at least one specific device. Preferably, said identification data are unique with respect to each user or each hearing device respectively, since this way, mix-ups and mistakes can be avoided.

Then, said data related to a multitude of users and/or to a multitude of hearing systems is accessed, and by means of said identification data, said data related to said specific user and/or to said specific hearing system are obtained. This is preferably carried out automatically, too, since this way, time can be saved and manual actions and mistakes can be reduced. The retrieved device data or user data can be for instance the specific user's audiological data or other data related to the hearing of the user, the type of battery suitable for said specific hearing system or the specific user's name.

Said identification data, said device data and said user data are usually data in digital form.

Said identification data, device data and user data are preferably stored electronically, in particular in a computer memory.

In one embodiment, said event is an interaction, e.g. a service action providing service for said specific user and/or for said specific hearing system, in particular involving the physical presence of said specific user and of at least one device of said specific hearing system. In particular, such a service action for said specific user and/or for said specific hearing system comprises at least one of the group comprising adjusting at least one device of said hearing system concerned;

repairing at least one device of said hearing system concerned;

checking at least one device of said hearing system concerned;

cleaning at least one device of said hearing system concerned;

dispensing an accessory suitable for said hearing system concerned;

dispensing a consumable suitable for said hearing system concerned.

In one embodiment, which corresponds to a first aspect of the invention, said automatically monitoring or detecting said event comprises detecting that the term of a scheduled appointment with said specific user is due within an adjustable or predeterminable period.

In the corresponding arrangement, said detecting module comprises a detector for detecting that the term of a scheduled appointment with said specific user is due within an adjustable or predeterminable period.

Nowadays, it is quite common to manage appointments by means of an electronic appointment book or electronic calendar, typically implemented as a program running on a computer or personal digital assistant. Said detector can, e.g. continuously compare the current time with the points in time of scheduled appointments entered in said program. E.g., five, ten or fifteen minutes before an appointment is due, identity data are extracted from the electronic appointment book in form of the name of the specific user having said appointment and further action can be taken, e.g., retrieving data related to said specific user from the database.

In another embodiment, which corresponds to a second aspect of the invention, said automatically monitoring or detecting of said indications comprises detecting, by means of a detector, that said specific device is located within an adjustable or predeterminable detection range of said detector.

In particular, it may comprise detecting that said specific device is located within the range of a wireless network to which said specific device is responsive.

In the corresponding arrangement, said detecting module comprises a detector for detecting that said specific device is located within an adjustable or predeterminable detection range of said detector.

In particular, it may comprise a detector for detecting that said specific device is located within an adjustable or predeterminable range of a wireless network or wireless communication device to which said specific device is responsive.

Accordingly, the physical presence of said specific device or said specific hearing system respectively in the detection area of the detector is detected. Preferably, this is done in a non-contact, wireless fashion. This may be accomplished, e.g., by RFID (radio frequency identification) with an RFID chip provided in or at the at least one specific device and a corresponding RFID reader near the entrance of the hearing care professional's office. Other proximity-detecting techniques may be used as well. The identification data may as well be transmitted using RFID.

A preferred way of detecting the physical presence of said at least one specific device makes use of the fact, that nowadays many hearing device are provided with wireless network capabilities, which are typically used for communicating within a hearing system comprising, in addition to one hearing device, another hearing device and/or a remote control, or for receiving audio signals from a remote microphone. Hearing devices with wireless network capabilities are known in the art, e.g., in the field of hearing-aid devices. The use of said wireless network capabilities for proximity sensing has the advantage, that it can be realized with existing technology. Near the entrance of the hearing care professional's office, means for establishing a wireless network can be foreseen, and said detection of said indication indicative of said forthcoming interaction can be accomplished by recognizing that the hearing system connects to said wireless network, wherein already the connection of only one device of the hearing system to the wireless network means a connection of the hearing system to the wireless network. The identification of the specific user and/or specific hearing system may also be accomplished by means of said wireless network.

The physical presence of said specific hearing system is a very good indicator for the physical presence of said specific user, since hearing systems usually worn or carried by the user. Accordingly, it can be expected that the user, when his presence is detected, wants to see his hearing care professional or a related person like the receptionist for some—scheduled or unscheduled—appointment, an examination, a repair request, a purchase or for some other interaction.

In one embodiment, which applies to the first as well as to the second aspect of the invention, the method comprises the step of launching a program, in particular a fitting program, suitable for said specific hearing system upon receiving launching data, which are derived in dependence of said identification data or identical with said identification data.

The corresponding arrangement comprises a launching module operationally connected to said identifying module and/or to said data accession module, for launching a program, in particular a fitting program, suitable for said specific hearing system upon said output of said identification data and/or upon receiving launching data, which are derived in dependence of said identification data or identical with said identification data.

As has been indicated before, it usually takes a considerable amount of time to launch a fitting program suitable for a specific hearing system. Instead of manually launching the fitting program, the invention allows to do this before the fitting session has started, even in an automated fashion. After it has been detected that there will be an interaction with the user, in particular a fitting session, the suitable program can be launched. When the specific user and the hearing care professional will have entered the examination room, in which the computer with the fitting program is located, the appropriate fitting software will already be running, and no time is wasted by manually launching the program while said specific user and said hearing care professional have to wait for the launching process to finish.

In one embodiment of this method, said device data or user data are retrieved or accessed by said program, and in particular, wherein said device date or user data comprise data related to the hearing of said specific user.

In the corresponding arrangement, said data accession module is operationally connected to said program and provides said program with said device data or user data, in particular wherein said device date or user data comprise data related to the hearing of said specific user, in particular audiological data of said specific user.

This way, not only the suitable fitting program can be launched in advance, but the fitting program may also be provided with the appropriate data related to the user, in particular, related to the hearing of the user.

In one embodiment, which applies to the first as well as to the second aspect of the invention, the method comprises the step of loading data-logging data from said specific hearing system.

The corresponding arrangement comprises a data loader initiating a procedure for loading data-logging data from said specific hearing system. Data logging and corresponding embodiments are described below in conjunction with the Figures. Said loading is preferably accomplished in a wireless fashion.

It is possible to carry out all steps of the described methods automatically. This allows for a full automation and corresponding time savings.

In one embodiment of the arrangement, said data source is comprised in the arrangement.

A method according to the invention can, in one embodiment, be a method for maintaining a specific hearing system, and a system according to the invention can, in one embodiment, be a system for maintaining a specific hearing system.

A method for maintaining a specific hearing system may comprise the step of using a program suitable for said specific hearing system for adjusting said specific hearing system.

A system for maintaining a specific hearing system may comprise a computer on which a program suitable for said specific hearing system is running or at least installed.

The expression "maintaining a hearing device" comprises at least fitting and adjusting, updating, repairing and checking a hearing device.

A method according to the invention can, in one embodiment, be a method for dispensing consumables or accessories for a specific hearing system, and a system according to the invention can, in one embodiment, be a system for dispensing consumables or accessories for a specific hearing system.

In one embodiment of said method for dispensing consumables or accessories for a specific hearing system, said identification data are related to said specific device, and the method comprises the step of selecting a consumable or accessory suitable for said specific hearing system in dependence of said identification data.

In addition, it may comprise the step of dispensing said consumable or accessory.

In one embodiment, said system for dispensing consumables or accessories for a specific hearing system comprises a selecting module for selecting a consumable or accessory suitable for said specific hearing system, wherein said selection is made in dependence of said identification data.

In addition, it may comprise a dispenser for dispensing said selected consumable or accessory.

Accordingly, such a system can be, e.g., an automatic dispensing machine working, e.g., as follows: A hearing device user with his at least one device of his hearing system approaches the automatic dispensing machine, which is detected by the machine. Thereupon, the at least one specific device of the hearing system is identified. Based on the corresponding identification data, the machine looks up, which type of consumable or accessory is suitable for the specific hearing system, selects a user-specified number of these suitable items and dispenses them upon user request. The method may include preparing or accomplishing a payment.

As far as the various parts of the arrangements and systems according to the invention are concerned (they are mostly termed "module"), these are basically functional units. Therefore, they may be arranged in various ways: groups of them can be fully or in part identical, and on the other hand, it is possible to realize any of them as separate units. For example, said identifying module may be separate from said detecting module or, at least in part, be identical with at least a part thereof.

The advantages of the methods correspond to the advantages of corresponding apparatuses.

Further preferred embodiments and advantages emerge from the dependent claims, the description and the figures.

BRIEF DESCRIPTION OF THE DRAWINGS

Below, the invention is described in more detail by means of examples and the included drawings. The figures show schematically.

The reference symbols used in the figures and their meaning are summarized in the list of reference symbols. Generally, alike or alike-functioning parts are given the same or similar reference symbols. The described embodiments are meant as examples and shall not confine the invention.

DETAILED DESCRIPTION OF THE INVENTION

Please note that in the figures, merely functionally-defined modules or units are drawn. When implemented in form of electronics or, in particular, in form of programs, i.e., computer software, it is, of course, possible to jointly implement several of these in one circuit or in one program, respectively.

As has been mentioned above, it is possible to divide the invention into at least two aspects, depending on how it is detected that an interaction with a user of a hearing system is to be expected.

1. Embodiments According to a First Aspect of the Invention

According to the first aspect of the invention, the detection of a forthcoming interaction with the user of the hearing system is accomplished by detecting that the point in time of a scheduled appointment with said user is due within a prescribable span of time.

Figure 1:
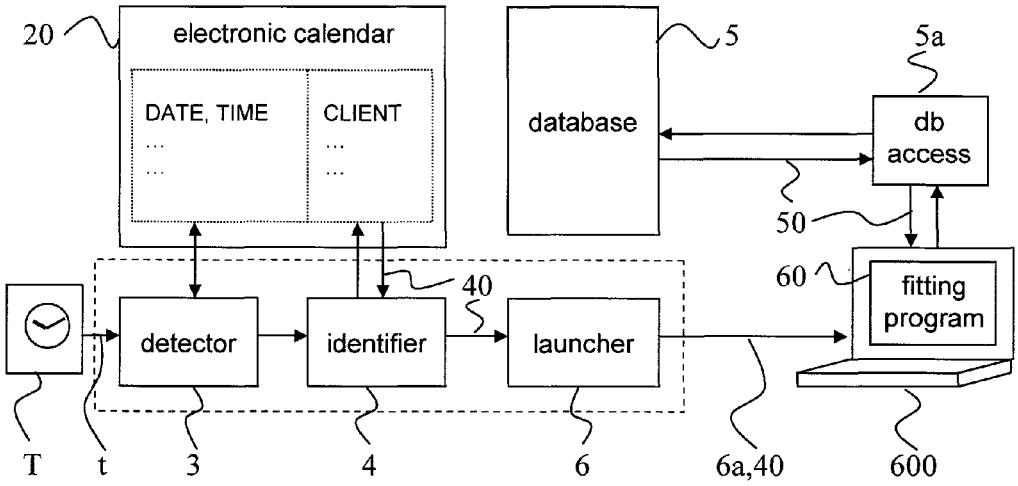
FIG. 1 an illustration of an embodiment according to a first aspect of the invention, with launching of a suitable program.

FIG. 1 shows an illustration of an exemplary embodiment. The hearing care professional with whom the user of the hearing system has made an appointment uses an electronic calendar 20, also referred to as electronic appointment book, for managing his appointments. Typically, such an electronic calendar 20 is embodied as a program running on a general-purpose computer. Such programs are widespreadly used in firms and offices. In the electronic calendar 20, the date and time of the appointments and the corresponding clients, i.e. the corresponding hearing system users, are stored, wherein the user is typically referred to by his name or possibly by a client number.

The system according to this embodiment comprises at least a detecting module 3, an identifying module 4 and a launching module 6. The detecting module 3 receives the current date and time t from a clock T and accesses the electronic calendar 20. When the detecting module 3 detects that an appointment listed in the electronic calendar 20 is scheduled to take place within a prescribable period, which in the case of the embodiment of FIG. 1 may be between 1 min and 30 min, in particular between 4 min and 15 min, the detecting module 3 will notify the identifying module 4 of this event.

The detecting module 3 can be embodied as a program running on a general-purpose computer, e.g., the same on which the electronic calendar 20 is running. It is also possible to incorporate the function of the detecting module 3 in the electronic calendar 20.

When the identifying module 4 has been notified that an indication of a forthcoming appointment has been detected, the identifying module 4 will obtain data 40 identifying the respective user from the electronic calendar 20. These data 40 are also referred to as identification data 40. They are identical with the data stored in the electronic calendar 20 or with a part thereof. The identifying module 4 passes on the identification data 40 to the launching module 6.

It is advisable to foresee that the identification data 40 are unique with respect to each specific user, at least within the environment of one hearing care professional.

The identifying module 4 can be embodied as a program running on a general-purpose computer, e.g., the same on which the electronic calendar is running. It is also possible to incorporate the function of the identifying module 4 in the electronic calendar 20.

The launching module 6 can be embodied as a program running on a general-purpose computer, e.g., the same on which the electronic calendar 20 is running. It is also possible to incorporate the function of the launching module 6 in the electronic calendar 20.

It is furthermore possible to jointly implement the detection module 3 and the identifying module 4 together with the launching module 6, as indicated in FIG. 1 by the dashed rectangle.

Upon receiving the identifying data 40, the launching module 6 passes on the identifying data 40 as launching data **6*a* to a general-purpose computer 600, which may be—but typically is not—identical with the general-purpose computer on which the electronic calendar 20** is running.

There are two ways to interpret the following steps.

In a first interpretation, there is already a program 60 running, which is suitable for the specific hearing system of the user who is expected to turn up for the scheduled appointment. This program 60 is advised by the launching module 6 to access and retrieve data 50 related to said user and/or to his hearing system. Such data 50 may, in particular, be audiological data of said user or other data related to the hearing of the user. Such kinds of data are usually contained in a database 5 containing such kind of data for a multitude of users and/or for a multitude of hearing systems. For retrieving these data 50, said program 60 uses a database accession module 5*a*, which may itself be a program, and which may be incorporated in the database, incorporated in the program 60 or separate from these.

Typically, a fitting program, i.e., a program for adjusting a hearing system or a hearing device, is envisaged as said program 60.

In a second interpretation, a program 60 as described above is launched on the computer 600 upon receiving the launching data 6*a*. By means of the launching data 6*a* a suitable program 60 to be launched can be chosen. The program can then, typically based on the launching data 6*a*, retrieve data related to the specific user and/or to the specific user's hearing system in the manner described before.

An advantage of an embodiment according to FIG. 1 is that it provides for valuable time savings. No time has to be wasted for starting an appropriate program in the presence of the client (=user); before the user even enters the hearing care professional's office, the appropriate program 60 can be, in a fully-automated fashion, already started and/or the user-specific data can already be loaded within the appropriate program 60.

Figure 2:
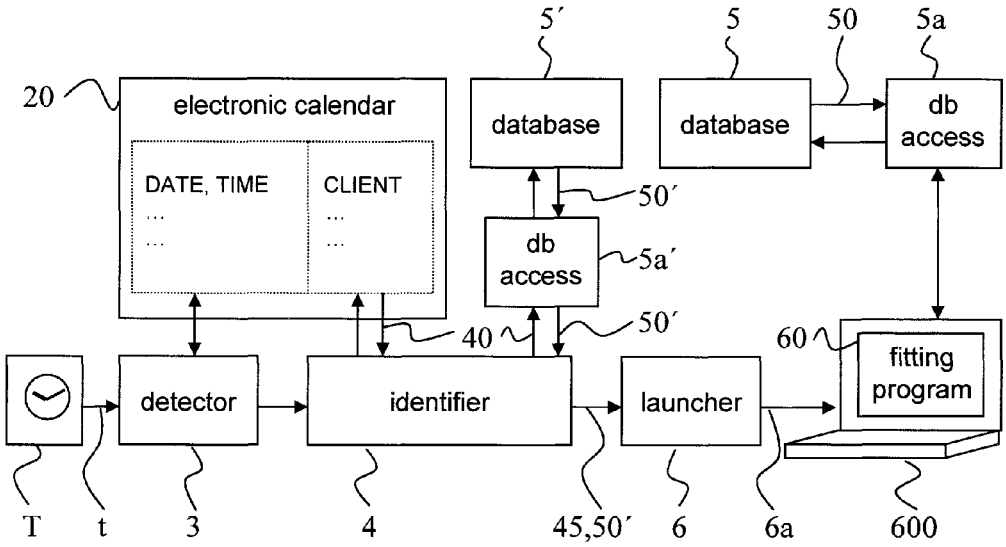
FIG. 2 an illustration of an embodiment according to a first aspect of the invention, with launching of a suitable program.

The embodiment illustrated in FIG. 2 is very similar to the one of FIG. 1. But the identifying module 4 retrieves data 50' from a database 5', via a database accession module 5*a*'. The background for this is as follows:

One hearing care professional typically deals with hearing devices of various manufacturers, and each hearing device manufacturer typically has its own fitting program or even different fitting programs for different hearing device models. Accordingly, in order to be able to launch that one specific program, which is suitable for the specific hearing system of the user having the appointment, rather detailed information on the hearing system is required. Furthermore, within the suitable program, usually the user of the specific hearing system has to be known in order to be able to retrieve the user-related data, e.g., audiograms, history of the fitting process and other data related to the hearing of the specific user.

Therefore, the identifying unit 4, after having received the identifying data 40, accesses, via said database accession module 5*a*', the database 5 and retrieves data 50'. The database 5' links identifying data 40, typically the user's name or a client number, to data, which either directly indicate the program 60 to be launched, or data from which the appropriate program 60 can be deduced. The latter data may be data indicating the manufacturer and model, possibly also the serial number, of the user's hearing system or of at least one device of the user's hearing system. The data retrieved from the database 5' are, possibly together with the identification data 40, passed on to the launching module 6 as data 45 derived independence of the identification data 40.

These data 45, or data derived therefrom, are passed on from the launching module 6 to the computer 600 as launching data 6*a*. Thereupon, the appropriate program 60 can be launched and the appropriate user-related data can be loaded. All this can happen in an automated fashion.

Figure 3:
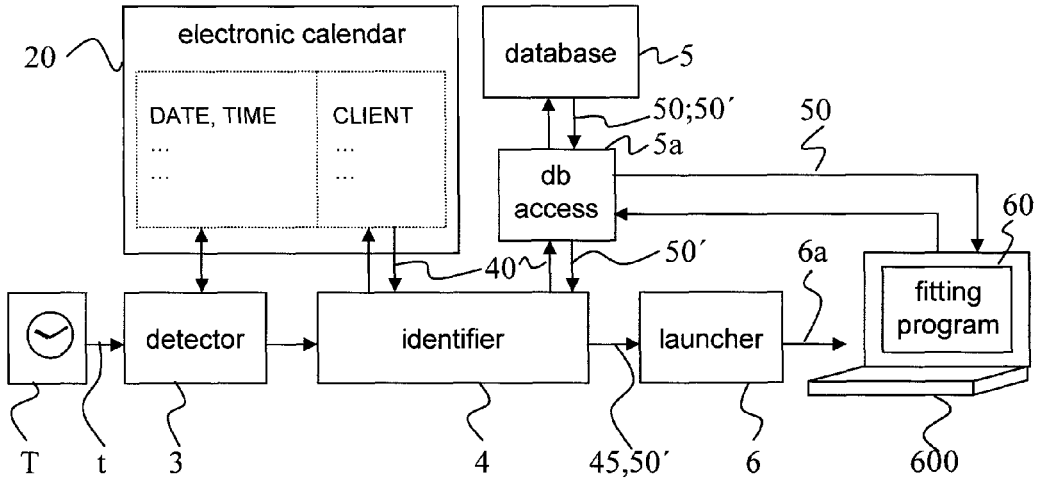
FIG. 3 an illustration of an embodiment according to a first aspect of the invention, with launching of a suitable program.

Although the databases 5 and 5' and the database accession modules 5*a*, 5*a*' have been drawn separately in FIG. 2, an implemenatation, in which the database accession modules 5*a* and 5*a*' and/or the database accession modules 5*a* and 5*a*' are identical, is also possible. Such an embodiment is drawn in FIG. 3.

Figure 4:
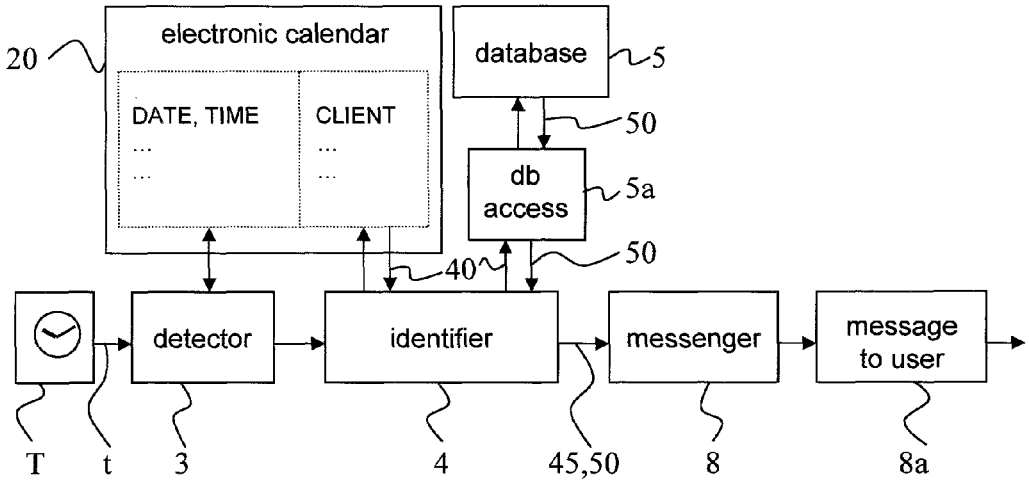
FIG. 4 an illustration of an embodiment according to a first aspect of the invention, with transmission of a message.

Another embodiment is illustrated in FIG. 4. It is very similar to the embodiment of FIG. 2, as far as the detection and the identification is concerned. But instead of launching a program suitable for the hearing system of the user, a message is sent to the user. This embodiment can be used for reminding the user of the appointment. In particular in the field of hearing-aid devices and corresponding hearing systems, the users are, to a high percentage, rather old, and therefore, also to a high percentage, somewhat forgetful. Therefore, it can be very advantageous to remind the user a while before the appointment is due, that the appointment is going to take place.

Therefore, the identifying module 4 outputs the data 45 derived in dependence of the identification data 40 to a messenger module 8, which initiates the transmission of a message 8*a* to the respective user. The messenger module 8 may be adapted to initiate the sending of a conventional letter,
an e-mail message,
a short-message-system (SMS) message,
a fax message, or
other messages as message 8*a*. Corresponding messenger modules 8 are readily available, e.g., programs that interface to an e-mail program, or programs interacing to a word processing program for automatic generation of reminder letters.

Said prescribable time span before the appointment is due is preferably chosen in dependence of the type of message to be transmitted. Examples: For an SMS message, the time span may be between 15 min and 4 hours (order of magnitude), for conventional mail 1 to 4 days, for fax and e-mail 12 hours to 3 days.

In this special embodiment illustrated in FIG. 4, the database 5 does not need to contain any data related to the user's hearing system or related to the hearing of the user. Only address data of the user, e.g., the user's telephone or fax number, postal or e-mail address should be comprised in the database 5 and passed on to the messenger module 8.

The function of the messenger module 8 may be embodied separately from the identifying module 4, or jointly therewith. The specific database 5 of FIG. 4 may be comprised in the electronic calendar 20.

Figure 5:
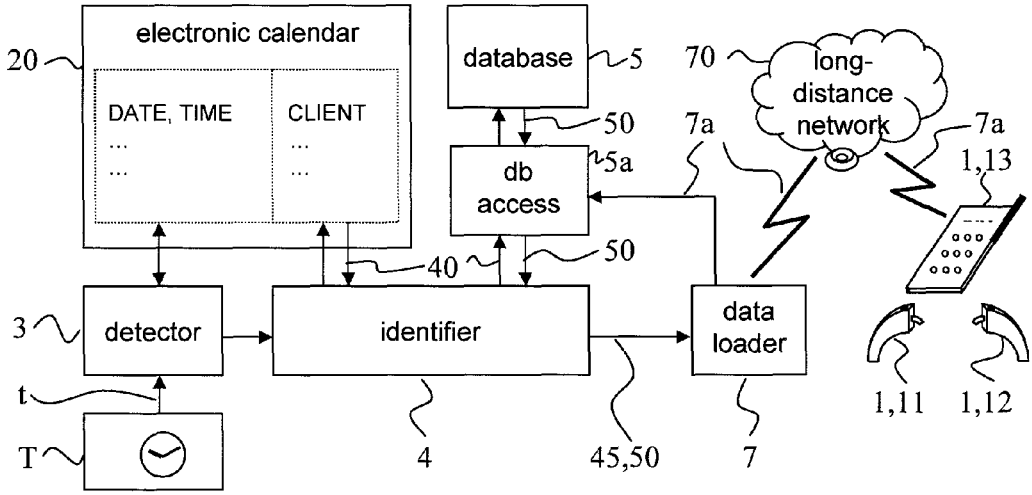
FIG. 5 an illustration of an embodiment according to a first aspect of the invention, with loading of logged data.

FIG. 5 illustrates another embodiment, which is similar to the embodiments of FIG. 2 and FIG. 4. In this embodiment, so-called data-logging data 7*a* are loaded into a database 5, which is accessible by the hearing care professional.

From EP 1 414 271 and US 2004/0190739, hearing systems are known which are capable of data logging. Data logging means, that in a hearing device and/or in a recording unit at least temporally operationally connected to the hearing device, information is recorded (logged), which relates to a point in time of the recording and/or a recording frequency, and to data and/or parameters and/or adjustments of the hearing device. The point in time of the recording and/or the recording frequency and the type of information (corresponding to data) concerning the hearing device to be recorded can be adjusted or programmed. By means of data logging, a multitude of the parameters adjustable in the hearing system can be recorded in actually existing acoustic environments and thereafter be checked or surveyed altogether or selectively. Based on an analysis of the recorded information, the hearing system and, in particular hearing programs, can be adjusted, typically by the hearing care professional.

Since data logging as well as the corresponding data-logging data and the corresponding hearing devices and methods are described in great detail in the above-mentioned publications, it is referred to these publications for further details, and EP 1 414 271 and US 2004/0190739 are herewith incorporated by reference in this application.

The identifying module 4 may receive the information, that the specific hearing system of the user who is expected for the appointment is capable of data logging or not, either from the electronic calendar 20, in which possibly a special remark for data logging is made, or rather from the database 5 via the database accession module 5*a*. In the latter case, the database 5 typically comprises data related to a multitude of hearing systems, namely at least the information whether or not a hearing system is capable of data logging, and this information can be accessed via the identification data 40.

When the user's hearing system is capable of data logging, a loading procedure for loading the data-logging data from the specific hearing system 1 is initiated. In the example of FIG. 5, the hearing system 1 is capable of communicating via a long-distance communication network 70, e.g., wirelessly. E.g., as drawn in FIG. 5, a remote control 13 of the hearing system 1 may by itself be able to communicate via a GSM, UMTS or another wireless communication network 70, or a device of the hearing system 1 can be operationally connected to a, possibly wireless, telecommunication device, which is then used for transmitting the data-logging data 7*a*.

A data loading module 7 initiates the procedure for loading the data-logging data 7*a*, and it preferably receives appropriate contact information, e.g., a telephone number of the hearing system or the appropriate telecommunication device, e.g., from the identifying module 4, which may have obtained this appropriate contact information from the database 5 or from elsewhere, e.g., from the electronic calendar 20. The loading of the data-logging data 7*a* may be fully automated. It is also possible that the data loading module 7 requests the user to transmit the data-logging data 7*a*.

As indicated in FIG. 5, the data loading module 7 may feed the data-logging data 7*a* via the database accession module 5*a* into the database 5. It is also possible to store the data-logging data in another database. Preferably, the data-logging data 7*a* are stored in one database together with other data related to the hearing of the user, e.g., the user's audiological data.

As has been indicated before, an analysis of the data-logging data 7*a* can provide valuable input for adjusting the hearing system 1. Therefore, said prescribable span of time will typically be between two hours and two days, thus allowing the hearing care professional to finish analyzing the data-logging data 7*a* before the appointment is going to take place and/or to analyze rather recent data-logging data 7*a*

Figure 6:
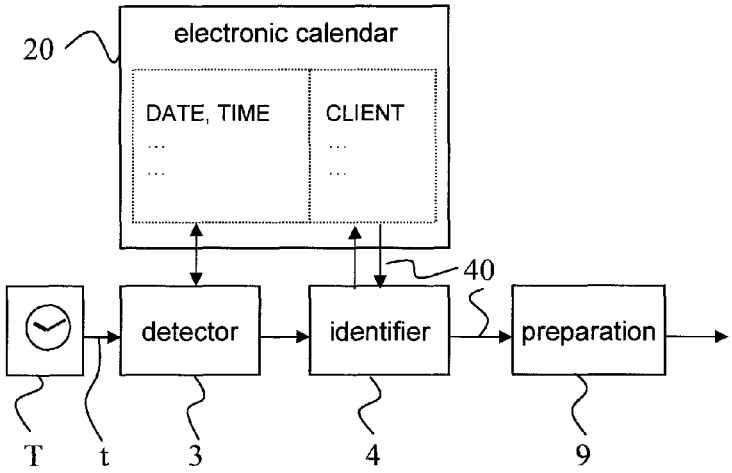
FIG. 6 an illustration of an embodiment according to a first aspect of the invention.

FIG. 6 illustrates a somewhat generalized embodiment according to the first aspect of the invention. It is similar to the embodiment of FIG. 1, but the identifying data 40 are fed to a preparation module 9 for taking or initiating a preparatory action for the scheduled appointment. Examples for such preparatory action are disclosed above in conjunction with the FIGS. 1 to 5.

When worded as a method, the somewhat generalized embodiment according to the first aspect of the invention can be described as a method for preparing a scheduled appointment of a specific user of a specific hearing system with a hearing care professional, comprising the steps of

- automatedly detecting that the point in time of said scheduled appointment is due within a prescribable span of time;
- obtaining identification data identifying said specific user and/or at least one device of said specific hearing system;
- using said identification data for taking or initiating a preparatory action for said scheduled appointment.

When worded as an apparatus or arrangement, the somewhat generalized embodiment according to the first aspect of the invention can be described as an arrangement for preparing a scheduled appointment of a specific user of a specific hearing system with a hearing care professional, comprising

- a detecting module for automatedly detecting, that the point in time of said scheduled appointment is due within a prescribable span of time;
- an identifying module operationally connected to said detecting module, for identifying said specific user and/or at least one device of said specific hearing system upon said detection of said indication, and for outputting identification data identifying said specific user and/or said at least one device;
- a preparation module receiving said identification data, for taking or initiating, in dependence of said identification data, a preparatory action for said scheduled appointment.

2. Embodiments According to a Second Aspect of the Invention

According to a second aspect of the invention, the detection of a forthcoming interaction with the user of the hearing system is accomplished by detecting, by means of a detector, that at least one device of the hearing system of the user is located within the detection range of said detector.

In this second aspect of the invention, also not-scheduled, spontaneous interactions can be dealt with.

The detector can be any proximity detector. It is sufficient that the detector is capable of detecting that an item to be detected is located within a detection range of the detector, wherein that detection range should be at least of the order of 0.1 m and at most of the order of 100 m, typically between 0.3 m and 10 m.

Wireless and non-contact methods for proximity detection are preferred.

For example, radio frequency identification (RFID), as commonly used in shops for detecting theft, can be used. It is also possible to implement the Bluetooth technology, which is commonly used for communication between computers and computer periphery and/or mobile communication devices and take advantage of the limited range of Bluetooth connections.

An advantageous way of detection makes use of the fact that hearing devices—and therefore also hearing systems—are known, which are capable of short-range wireless communication. Such hearing devices are disclosed, e.g., in U.S. Pat. No. 5,479,522, WO 01/54458 A2 and in WO 2004/110099 A2, where further details can be found, in particular regarding the communication networks and the involved devices. With respect to the second aspect of the invention, it can be made use of the limited range of a short-range network, namely by detecting the proximity of the hearing system user to, e.g., the office of the hearing care professional by detecting, e.g., that at least one device of the user's hearing system tries to connect to the short-range network established at the hearing care professional's office, or vice versa. Accordingly, the wireless network capability of a hearing system, which itself is known in the art, is used for proximity detection of the hearing system.

Figure 7:
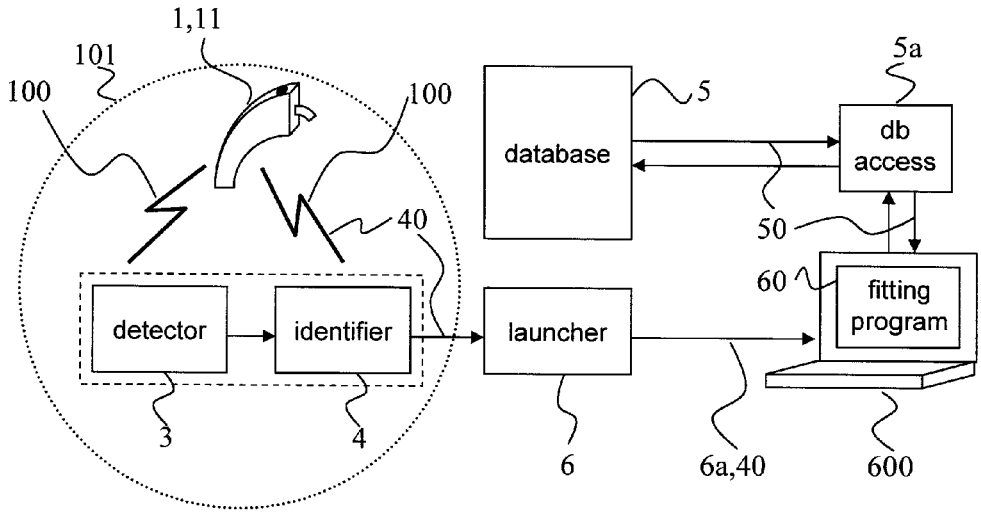
FIG. 7 an illustration of an embodiment according to a second aspect of the invention, with launching of a suitable program.

FIG. 7 is an illustration of an exemplary embodiment according this second aspect of the invention. The right part of FIG. 7 corresponds to the right part of FIG. 1. Therefore, it is referred to the description of FIG. 1 for details concerning the right part of FIG. 7. The left part makes the difference between the first and the second aspect of the invention.

A detecting module 3 and, operationally connected thereto, an identifying module 4 are installed in a suitable location, e.g., near the entrance of the hearing care professional's office. The detecting module 3 comprises a detector having a detection range 101. When an object to be detected, i.e., in FIG. 7, a hearing device 11 representing a hearing system 1, is located within said detection range 101, the detection module 3 will notify the identifying module 4 thereof.

The identifying module 4 thereupon obtains identification data 40 from the hearing device 11, which—preferably uniquely—identify the hearing system 1. Said identification data 40 are then fed to a launching module 6, like in the embodiment of FIG. 1.

The detection of the hearing device 11 may be accomplished using a short-range communication capability of the hearing device 11, and also the identification of the hearing device 11 may be accomplished using a short-range communication capability of the hearing device 11. As indicated by the dashed rectangle in FIG. 7, it is well possible to embody both, said detection module 3 and said identifying module 4 within one unit.

E.g., the following scenario is possible using the embodiment of FIG. 7: A user of a hearing system 1 enters, without an appointment, the office of his hearing care professional, because some adjustment of the hearing device 11 appears to be necessary. A short-range communication network established in the reception room of the hearing care professional recognizes that the hearing device 11, which is responsive to said short-range communication network, is trying to connect to the short-range communication network, i.e., the hearing device 11 is detected. Thereupon, the manufacturer, model and serial number of the hearing device 11 is requested via the short-range communication network, i.e., the hearing device 11 is identified. These data (identification data 40) are fed to a program (embodying the launching module 6), e.g., installed on computer 600, which on basis of this information selects the database record for the specific user of hearing device 11 and launches the appropriate fitting program for hearing device 11. After the user has been welcomed and seated in the examination room, the appropriate (fitting) software is already running, and a fitting session can begin immediately.

Figure 8:
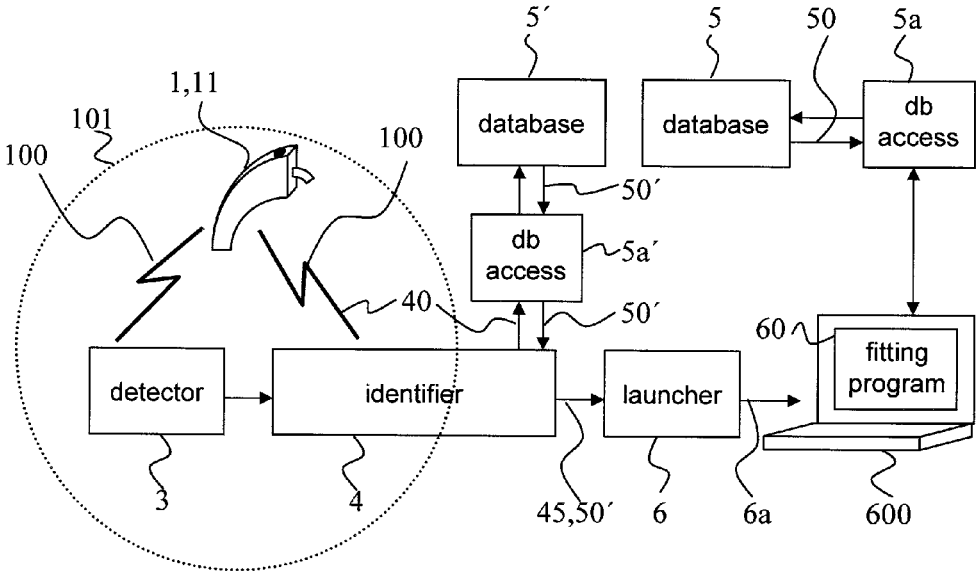
FIG. 8 an illustration of an embodiment according to a second aspect of the invention, with launching of a suitable program.

FIG. 8 illustrates another embodiment. The right part of FIG. 8 corresponds to the right part of FIG. 2. Therefore, it is referred to the description of FIG. 2 for details concerning the right part of FIG. 8. And the left part of FIG. 8 corresponds to the left part of FIG. 7. Therefore, it is referred to the description of FIG. 7 for details concerning the left part of FIG. 8.

Figure 9:
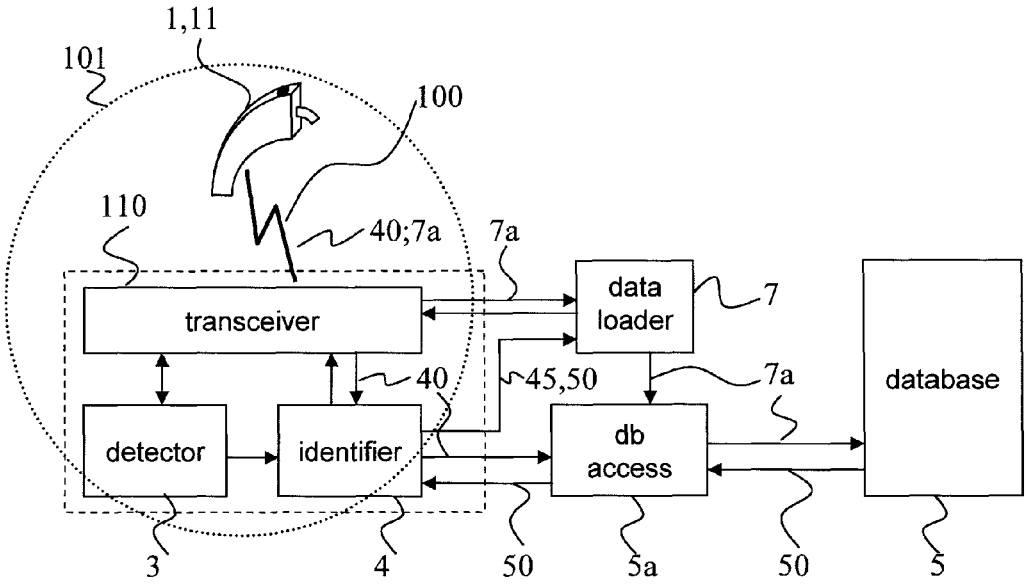
FIG. 9 an illustration of an embodiment according to a second aspect of the invention, with loading of logged data.

FIG. 9 illustrates another embodiment. Like in the embodiment of FIG. 5, data-logging data 7*a* can be loaded from the hearing device 11, which allows to obtain and store these data 7*a* in an appropriate place associated with the hearing care professional before the actual fitting session takes place, and possibly allows, in addition, to analyse these data 7*a* in advance.

The detecting/identifying part of the embodiment of FIG. 9 is drawn in a little more detail than in the Figures of the other embodiments according to the second aspect of the invention and may be used in these other embodiments as well.

As indicated by the dashed rectangle, a detecting module 3 and an identifying module 4 form together with a transceiver 110 one unit capable of communicating with the hearing device 11. The transceiver 110 is continuously or quasi-continuously monitored by a program (the detecting module 3), which notifies another program (the identifying module 4) when a wireless connection has been newly established. Thereupon, the identifying module 4 requests, via the transceiver 110, identification data 40 from the hearing device 11. Having received the identification data 40 from the hearing device 11, the identifying module 4 retrieves, via a database access module 5*a*, data 50 from a database 5, which indicate whether or not hearing device 11 (or hearing system 1) is capable of data logging, or data 50, which indicate that it is assumed that hearing device 11 (or hearing system 1) currently has data-logging data to be downloaded. If data-logging data shall be downloaded, a data loading module 7 is instructed accordingly. Data loading module 7 instructs the transceiver 110 to download the data-logging data 7*a* from the hearing device 11 (or from another device of the hearing system 1), and stores the data-logging data 7*a*, e.g., in the database 5 using the database accession module 5*a*.

Figure 10:
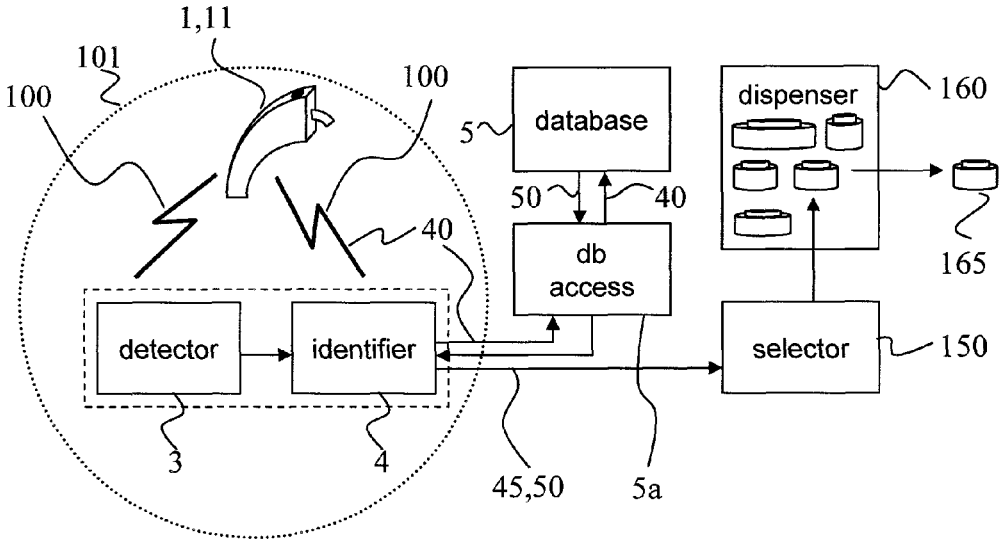
FIG. 10 an illustration of an embodiment according to a second aspect of the invention, with selecting and dispensing of consumables.

Another embodiment is illustrated in FIG. 10. In this embodiment, consumables 165 or accessories suitable for a hearing system 1 are selected and dispensed. It is possible to accomplish this task in an automated fashion. It is possible to dispense appropriate consumables 165 or accessories without the support of a hearing care professional or sales associate. The embodiment of FIG. 10 will be described in this way, i.e., as a vending machine, or more specifically, as an automatic battery dispenser for hearing devices.

The left part of FIG. 10 corresponds to the left part of FIG. 7. Therefore, it is referred to the description of FIG. 7 for details concerning the left part of FIG. 10. After the user of hearing system 1 has approached the vending machine, or more precisely, has entered the detection range 101 of the detection module 3, the hearing system 1 will be detected and identified. Possibly, the user enters a request to the vending machine, e.g., the desired number of batteries. Using the obtained identification data 40, e.g., manufacturer and model of the involved hearing device(s), data 50 are retrieved from database 5, which indicate the suitable type of batteries 165. These retrieved data 50 are fed to a selecting module 150, which selects the appropriate type of battery from a multitude of different batteries. A dispenser 160 then dispenses the selected battery 165 or batteries. Of course, it can be foreseen to request some kind of payment from the user before dispensing the battery, or the identification data 40 are stored together with information about the dispensed goods, so that the user can be billed later, or the amount can be deducted from a prepaid account.

By means of the described battery dispensing vending machine, the dispensing of wrong batteries can be avoided, and the hearing system user does not need to know the precise model of his hearing system or what type of batteries are required for the hearing system 1.

Figure 11:
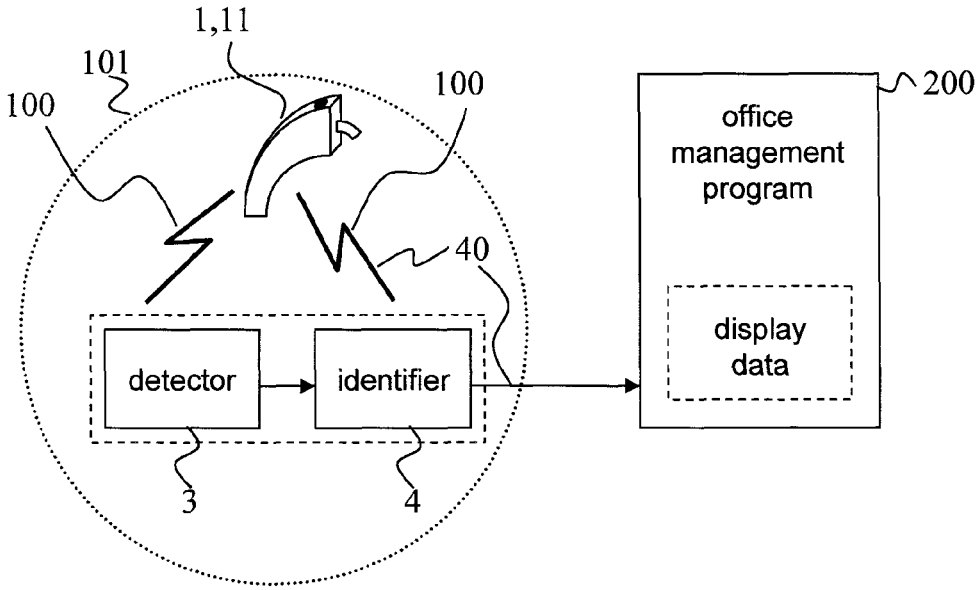
FIG. 11 an illustration of an embodiment according to a second aspect of the invention, with displaying of data in an office management program.

FIG. 11 shows a special embodiment. The left part of FIG. 11 corresponds to the left part of FIG. 7. Therefore, it is referred to the description of FIG. 7 for details concerning the left part of FIG. 11.

In the embodiment of FIG. 11, the identification data 40 obtained from the hearing system 40 are fed to an office management program 200 installed at the hearing care professional's office. An office management program is usually used for at least one of billing, managing addresses, correspondence purposes. The identification data 40 can then be displayed on a screen by the office management program 200, or—which is not drawn in FIG. 11—by the office management program 200 data can be displayed on a screen, which are derived from the identification data 40, e.g., using a database, like in one of FIGS. 8 to 10. It is also possible to use the identification data 40 for automatically selecting a client record in the office management program 200. It is also possible to use the identification data 40 for automatically displaying or selecting and then displaying information depicting an examination room into which the user shall be guided. Feeding the identification data 40 to the office management program 200 allows to use data in the office management program 200, which are not purely related to the user, but which are related to the user's hearing system 1.

3. Common Aspects, Other Aspects

Figure 12:
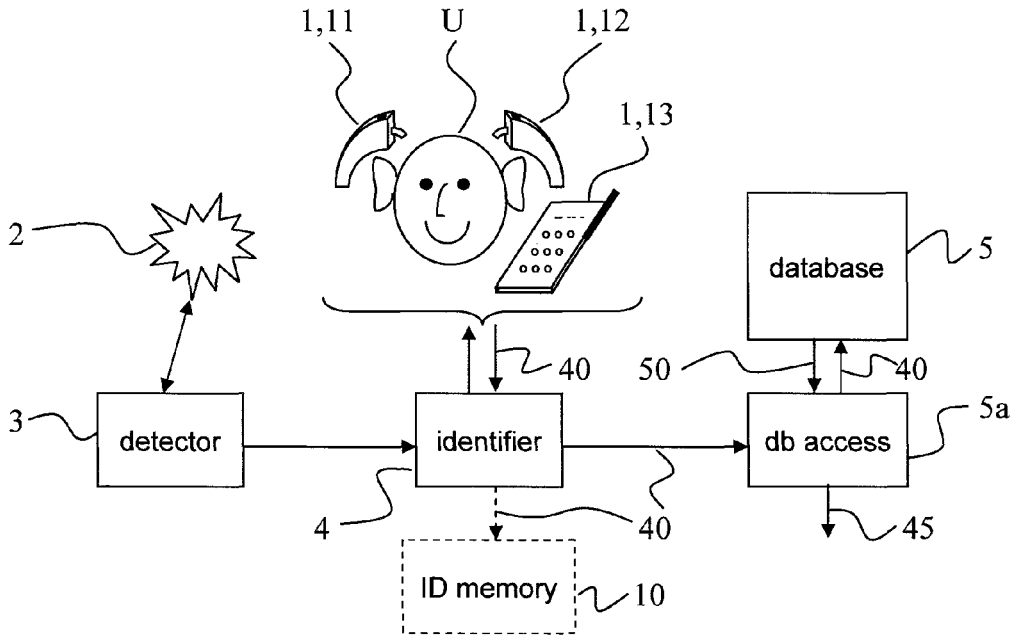
FIG. 12 an illustration of a general embodiment with database access.

FIG. 12 illustrates a rather general embodiment with database access. Many of the above-described embodiments share a number of features illustrated in FIG. 12. A detecting module 3 automatically detects an indication 2 indicative of a forthcoming interaction with a specific user U of a specific hearing system 1. Thereupon, an identifying module 40 obtains identification data 40 identifying said specific user U and/or at least one device 11, 12 and/or 13 of said specific hearing system 1. Thereupon, data 50 are retrieved from a database 5, in dependence of said identification data 40, wherein it is possible to derive data 45 (confer FIGS. 2, 3, 4, 5, 8, 9, 10) in dependence of the identification data 40, before retrieving the data 50 (not drawn in FIG. 12). That database 5 preferably comprises data related to a multitude of users including said specific user U and/or to a multitude of hearing systems including said specific hearing system 1. The data 50 can be used for various purposes, several of which have been described above. For example, the data 50 can comprise information

- on whether or not data-logging data can/shall be read from the hearing device;
- on suitable accessories or consumables;
- on whether or not a reminder before a scheduled appointment is desired;
- on appropriate programs to be launched, e.g., program name and version; and/or
- on the hearing of the specific user.

Usually, the identification data 40 are stored in a memory module 10, typically some computer memory.

Figure 13:
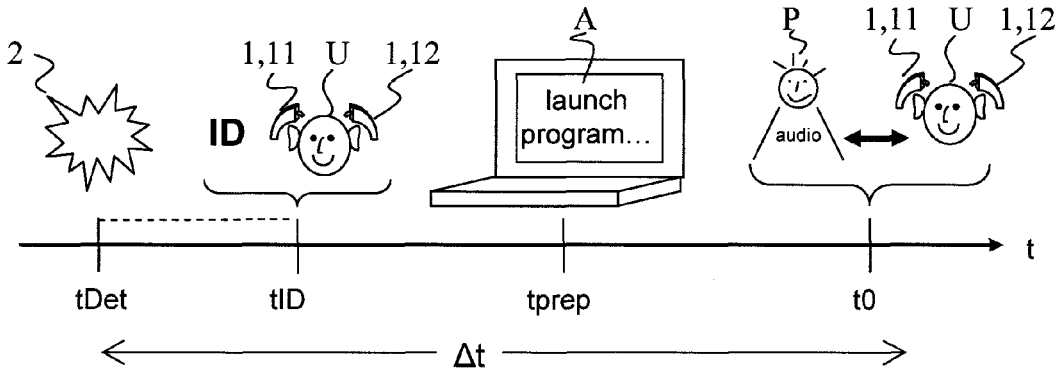
FIG. 13 an illustration of a succession of steps in time.

FIG. 13 illustrates the succession of steps, as it occurs in many of the above-described embodiments. At a time tDet, an indication of a forthcoming interaction with a user of a hearing system is detected. At the same time as tDet or after that, the user U and/or at least one device 11, 12 of the hearing system 1 of the user U is identified, at time tID. Thereupon, at a time tprep, a preparatory action A for said interaction, e.g., launching an appropriate fitting program, is initiated or taken. Then, the interaction takes place at time t0, e.g., the user U and the hearing care professional P have a fitting session for adjusting the hearing system 1. The time tDet is always before t0. In case of scheduled interactions, the time t0 lies within a prescribable time span Δt after tDet.

LIST OF REFERENCE SYMBOLS

1 hearing system
2 indication indicative of forthcoming interaction
3 detecting module, detector
4 identifying module
5, 5' database
5*a*, 5*a*' database accession module
6 launching module
6*a* launching data
7 data loader, data loading module
7*a* data-logging data, logged data
8 messenger module
8*a* message, reminder, letter, e-mail, short-message-system message
9 preparation module
10 memory module, computer memory
11 device, hearing device
12 device, hearing device
13 device, remote control
20 electronic calendar, electronic appointment book
40 identification data
45 data derived independence of identification data
50, 50' retrieved data
60 program, fitting program
70 long-distance network
100 wireless connection, short-range wireless connection
101 detection range, range of wireless network
110 transceiver, communication interface
150 selecting module
160 dispenser
165 consumable, battery
200 office management program
600 computer, general purpose computer
A action, preparatory action
P hearing care professional, person related to hearing care professional
t time
t0 term, term of service interaction, term of scheduled appointment, term of fitting session
tDet term of detection of indication
tID term of obtaining identification data
tprep term of preparatory action, of program launching, of data retrieving or of other action
T clock
U user
Δt period, adjustable or predeterminable period

What is claimed is:

1. Method comprising the steps of:

automatically monitoring or detecting indications indicative of a forthcoming event concerning hearing systems scheduled to be performed at a predetermined time;

if such an indication is detected, automatically retrieving in response to detection of said indication of said forthcoming event, identification data identifying at least one device of the hearing system concerned, referred to as specific device, or a user of said hearing system concerned, referred to as specific user; and using said identification data for retrieving, prior to said predetermined time, further data related to said specific device as device data or related to said specific user as user data so that the device data or the user data is available to be utilized during the forthcoming event scheduled at the predetermined time.

2. Method according to claim 1, wherein said identification data is retrieved from at least one database comprising data related to a multitude of users or a multitude of hearing systems.

3. Method according to claim 1, wherein said event is a service action providing service for said specific user and/or for said specific hearing system and involving the physical presence of said specific user and of at least one device of said specific hearing system, and wherein said service for said specific user and/or for said specific hearing system comprises at least one selected from the group consisting of:

adjusting at least one device of said hearing system concerned;

repairing at least one device of said hearing system concerned;

checking at least one device of said hearing system concerned;

cleaning at least one device of said hearing system concerned;

dispensing an accessory suitable for said hearing system concerned; and dispensing a consumable suitable for said hearing system concerned.

4. Method according to claim 1, wherein said automatically monitoring or detecting of indications comprises at least one selected from the group consisting of:

a) detecting that the term of a scheduled appointment with said specific user is due within an adjustable or predeterminable period;

b) detecting, by means of a detector, that said specific device is located within an adjustable or predeterminable detection range of said detector; and c) detecting that said specific device is located within the range of a wireless network or wireless communication device to which said specific device is responsive.

5. Method according to claim 1, further comprising the step of launching a program upon receiving launching data, which are derived in dependence of said identification data.

6. Method according to claim 5, wherein said device data or user data are retrieved or accessed by said program, and wherein said device data or user data comprise data related to the hearing of said specific user.

7. Method according to claim 5, wherein said program is a fitting program suitable for said specific hearing system.

8. Method according to claim 1, comprising the step of loading data-logging data from said specific hearing system.

9. Method according to claim 1, comprising the step of initiating the transmission of a message to said specific user upon detecting that the term of a scheduled appointment with said specific user is due within an adjustable or predeterminable period.

10. Method according to claim 1, comprising the step of storing said identification data in a computer memory.

11. Method according to claim 1, wherein each of said steps is carried out automatically.

12. Method for maintaining a specific hearing system, comprising the method according to claim 1.

13. Method according to claim 12, comprising the step of using a program suitable for said specific hearing system for adjusting said specific hearing system.

14. Method for dispensing consumables or accessories suitable for a specific hearing system, comprising the method according to claim 1.

15. Method according to claim 14, wherein said identification data are related to said specific device, said method comprising the step of selecting a consumable or accessory suitable for said specific hearing system in dependence of said identification data.

16. Method according to claim 15, comprising the step of dispensing said consumable or accessory.

17. Method according to claim 1, wherein said using said identification data for retrieving further data related to at least one of said specific device and said specific user occurs before said forthcoming event occurs.

18. Method according to claim 17, wherein said forthcoming event is a service action providing service for said specific user and/or for said specific hearing system during which an interface unit is to establish communication between a computer and the specific device, and said using said identification data occurs before communication between the computer and the specific device is established during said service action.

19. Arrangement comprising:

a detecting module for automatically monitoring or detecting indications indicative of a forthcoming event concerning hearing systems scheduled to be performed at a predetermined time;

an identifying module operationally connected to said detecting module, for automatically retrieving in response to detection of said indication of said forthcoming event, identification data of at least one device of the hearing system concerned, referred to as specific device, or of a user of said hearing system concerned, referred to as specific user, and for outputting identification data identifying said specific user or said specific device; and a data accession module operationally connectable to data sources comprising data related to users of hearing systems or data related to hearing systems or data related to hearing devices, for retrieving, prior to said predetermined time, further data from said data sources related to said specific user as user data or to said specific device as device data, and for outputting said user data or device data, wherein the data accession module commences retrieval of the device data or the user data in advance of the predetermined time to make the device data or the user data available to be utilized during the forthcoming event scheduled at the predetermined time.

20. Arrangement according to claim 19, wherein said data sources are databases comprising data related to the hearing of said specific user, and wherein said user data or device data comprise data related to the hearing of said specific user.

21. Arrangement according to claim 19, wherein said detecting module comprises at least one selected from the group consisting of:

a) a detector for detecting that the term of a scheduled appointment with said specific user is due within an adjustable or predeterminable period;

b) a detector for detecting that said specific device is located within an adjustable or predeterminable detection range of said detector; and c) a detector for detecting that said specific device is located within the range of a wireless network or wireless communication device to which said specific device is responsive.

22. Arrangement according to claim 19, comprising a launching module operationally connected to said identifying module and/or to said data accession module, for launching a program suitable for said specific hearing system upon said output of said identification data and/or upon receiving launching data, which are derived in dependence of said identification data or identical with said identification data.

23. Arrangement according to claim 22, wherein said data accession module is operationally connected to said program and provides said program with said device data or user data, and wherein said device data or user data comprise data related to the hearing of said specific user.

24. Arrangement according to claim 22, wherein said program is a fitting program.

25. Arrangement according to claim 19, comprising a data loader initiating a procedure for loading data-logging data from said specific hearing system.

26. Arrangement according to claim 19, comprising a messenger module initiating the transmission of a message to said specific user upon detecting that the term of a scheduled appointment with said specific user is due within an adjustable or predeterminable period.

27. Arrangement according to claim 19, comprising a computer memory, in which said identification data are stored after having been obtained.

28. Arrangement according to claim 19, comprising said data source.

29. System for maintaining a specific hearing system comprising the arrangement according to claim 19.

30. System according to claim 29, comprising a computer on which said program suitable for said specific hearing system is installed.

31. System for dispensing consumables or accessories for a specific hearing system comprising the arrangement according to claim 19.

32. System according to claim 31, comprising a selecting module for selecting a consumable or accessory suitable for said specific hearing system, wherein said selection is made in dependence of said identification data.

33. System according to claim 32, comprising a dispenser for dispensing said selected consumable or accessory.

* * * * *